US007467675B2

(12) United States Patent
Lay

(10) Patent No.: US 7,467,675 B2
(45) Date of Patent: Dec. 23, 2008

(54) DEVICE FOR CHANNELING SOLIDS AND FLUIDS WITHIN A REVERSE CIRCULATION DRILL

(75) Inventor: Warren T. Lay, Catawba, VA (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 246 days.

(21) Appl. No.: 11/448,172

(22) Filed: Jun. 6, 2006

(65) Prior Publication Data

US 2007/0278010 A1 Dec. 6, 2007

(51) Int. Cl.
*E21B 4/14* (2006.01)

(52) U.S. Cl. ..... 175/296; 175/417

(58) Field of Classification Search ..... 175/293, 175/296, 297, 417
See application file for complete search history.

(56) References Cited

U.S. PATENT DOCUMENTS

| | | | | |
|---|---|---|---|---|
| 3,941,196 | A * | 3/1976 | Curington et al. | 175/100 |
| 4,706,764 | A | 11/1987 | Hughes | |
| 4,819,746 | A | 4/1989 | Brown et al. | |
| 4,921,052 | A | 5/1990 | Rear | |
| 5,085,285 | A | 2/1992 | Elsby et al. | |
| 5,154,244 | A | 10/1992 | Elsby et al. | |
| 5,301,761 | A | 4/1994 | Fu et al. | |
| 5,407,021 | A | 4/1995 | Kane et al. | |
| 5,685,380 | A | 11/1997 | Purcell et al. | |
| 5,778,993 | A | 7/1998 | Moir | |
| RE36,002 | E | 12/1998 | Elsby et al. | |
| 6,035,953 | A | 3/2000 | Rear | |
| 6,209,665 | B1 | 4/2001 | Holte | |
| 6,386,301 | B1 | 5/2002 | Rear | |
| 6,550,554 | B2 | 4/2003 | Gien | |
| 6,702,045 | B1 | 3/2004 | Elsby | |
| 7,152,700 | B2 | 12/2006 | Church et al. | |
| 2008/0029307 | A1 * | 2/2008 | Green | 175/296 |

* cited by examiner

*Primary Examiner*—William P Neuder
(74) *Attorney, Agent, or Firm*—Michael Best & Friedrich LLP

(57) ABSTRACT

A device is for channeling solids and fluids within a reverse circulating, fluid operated drill that has first and second ends, an axis extending between the ends, a casing and a piston. The casing has a bore extending between the drill ends and drive and valve chambers defined within the bore, the piston being movably disposed within the bore. The channeling device includes an elongated body disposeable within the casing bore so as to extend along the casing axis and through the piston. The body has a longitudinal axis, a first end locatable proximal to the drill first end, and a second end spaced from the first end and locatable proximal to the drill second end. A material transport passages extends axially between the two body ends and provides a path for moving solid materials through the drill. A fluid passage is configured to couple the valve and drive chambers.

35 Claims, 8 Drawing Sheets

DEVICE FOR CHANNELING SOLIDS AND FLUIDS WITHIN A REVERSE CIRCULATION DRILL

The present invention relates to a down-hole drills, and more particularly to sampling devices for reverse circulation down-hole drills.

Reverse circulation down-hole drills are known and basically operate, as with other percussive drills, by high pressure fluid (e.g., compressed air) that is appropriately directed in order to reciprocate a piston to repetitively impact against a bit, the bit having plurality of cutting inserts used to cut or bore through materials such as earth and stone. These fluid operated drills generally have a drive chamber into which the high pressure fluid is directed in order to drive the piston from an initial position to impact the bit. Further, a valve is typically provided to control the flow of percussive fluid into the chamber to operate the piston.

Unlike other percussive down-hole drills, reverse circulation drills typically include a sampling or material collection tube extending centrally through the drill between the drill upper and lower ends. Additionally, reverse circulation drills are appropriately constructed so as to direct "exhaust" fluid from the drive chamber downwardly and outwardly around the perimeter of the bit lower face, which subsequently flows radially inwardly across the bottom face of the bit. As the fluid flows across the bit lower face, solid particles (e.g., rock bits, soil, etc.) are entrained in the fluid flow, and are subsequently carried with the fluid flow as the flow enters a port(s) in the bit face, thereafter flowing into the collection tube to be carried upwardly and out the top end of the drill.

SUMMARY OF THE INVENTION

In one aspect, the present invention is a device for channeling solids and fluids within a reverse circulating, fluid operated drill. The drill has first and second ends and an axis extending between the ends and including a casing, the casing having a central longitudinal bore extending generally between the drill first and second ends, and a drive chamber and a valve operation chamber each defined within the bore. Also, a piston is movably disposed within the casing bore. The channeling device basically comprises an elongated body disposeable at least partially within the casing bore so as to extend generally along the casing axis and through the piston bore. The body has a central longitudinal axis, a first end locatable generally proximal to the drill first end and a second end spaced axially from the first end and locatable generally proximal to the drill second end. A material transport passage extends axially between the body first and second ends and provides a path for moving solid materials through the drill. Further, the body also has a fluid passage is configured to fluidly couple the valve and drive chambers.

In another aspect, the present invention is a fluid operated drill comprising a casing having first and second ends, a longitudinal bore extending between the two ends, an axis extending centrally through the bore, and a drive chamber and a valve activation chamber each defined within the bore. A piston is movably disposed within the casing bore in opposing directions along the casing axis. Further, a channeling device includes an elongated body disposeable at least partially within the casing bore so as to extend generally along the casing axis and through the piston bore. The body has a first end located generally proximal to the casing first end and a second end located generally proximal to the casing second end. The body also has a material transport passage extending between the body first and second ends and providing a path for moving solid materials through the drill and a fluid passage configured to fluidly couple the valve and drive chambers.

In a further aspect, the present invention is again a device for channeling solids and fluids within a reverse circulating, fluid operated drill. The drill has first and second ends and an axis extending between the ends and includes a casing. The casing has a central longitudinal bore extending generally between the drill first and second ends and a drive chamber and a valve operation chamber each defined within the bore. Also, a piston is movably disposed within the casing bore. Basically, the channeling device comprises first and second generally circular tubes. The first tube is disposeable at least partially within the casing bore so as to extend generally along the casing axis and through the piston bore. The first tube has a central longitudinal axis, an outer end locatable generally proximal to the drill first end, an inner end spaced axially from the outer end, and a central bore extending between the inner and outer ends. The second tube is disposeable at least partially within the casing bore so as to extend generally along the casing axis and is spaced axially from the first tube. The second tube has an outer end locatable generally proximal to the drill second end, an inner end spaced axially from the outer end, and a bore extending between the first and second ends. Further, the second tube inner end is connectable with the first tube inner end so as to at least partially form a fluid passage configured to fluidly couple the valve and drive chambers and to connect the bores of the first and second tubes to form a material transport passage. The transport passage provides a path for moving solid materials through the drill.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
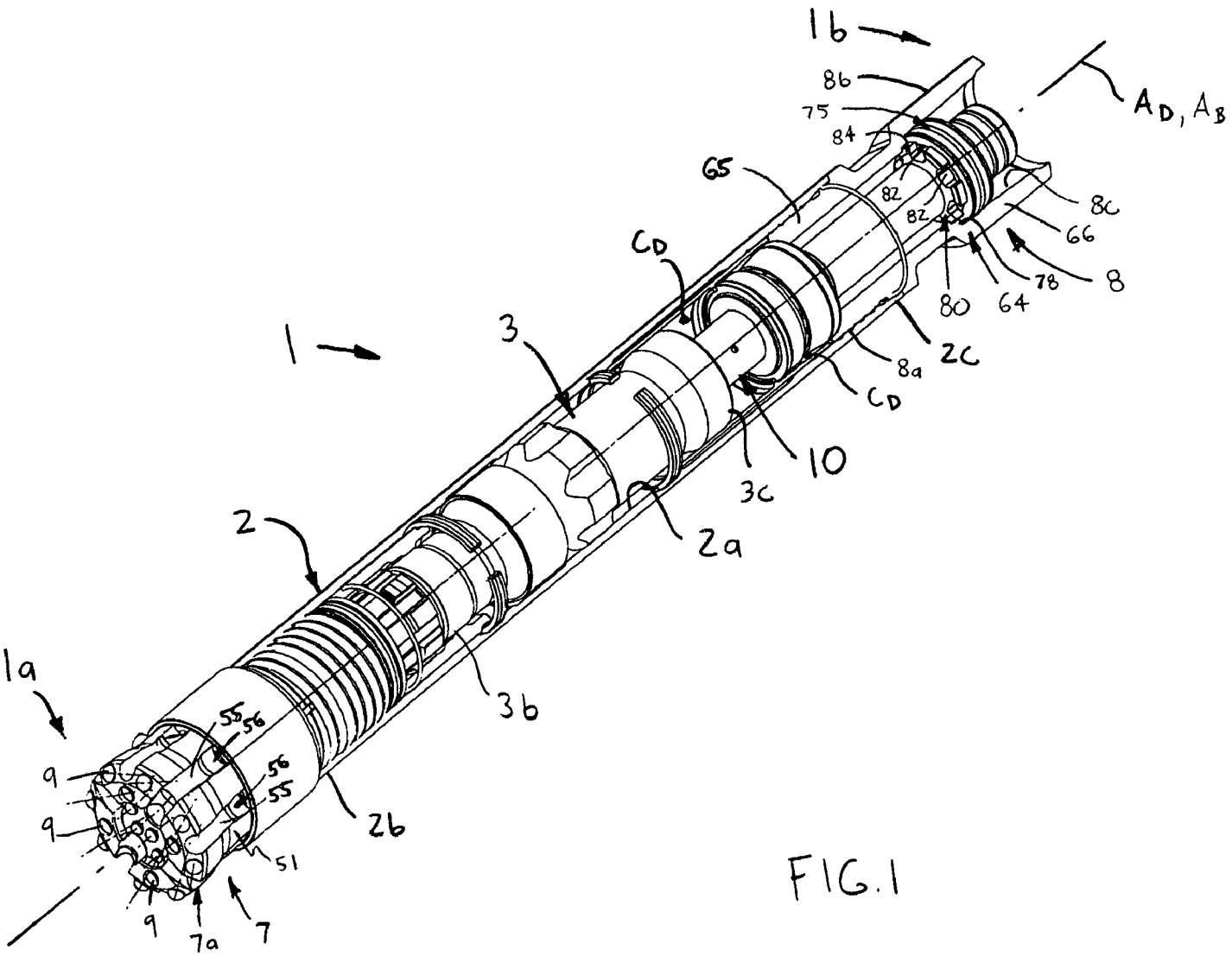
FIG. 1 is a partly broken-away, perspective view of a reverse-circulation drill having a channeling device in accordance with the present invention.

Certain terminology is used in the following description for convenience only and is not limiting. The words "right", "left", "lower", "upper", "upward", "down" and "downward" designate directions in the drawings to which reference is made. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words of similar import. Furthermore, the term "position" is used herein to indicate a position, location, configuration, orientation, etc., of one or more components of a drill or/and a channeling device and each is depicted in the drawings with reference to a randomly selected point on the item being described. Such points in the drawing figures are randomly selected for convenience only and have no particular relevance to the present invention.

Referring now to the drawings in detail, wherein like numbers are used to indicate like elements throughout, there is shown in FIGS. 1-13 a device for channeling solids and fluids within a reverse circulation, fluid operated drill 1, the drill 1 having first and second ends 1*a*, 1*b* and an axis $A_D$ extending between the two ends 1*a*, 1*b*. The drill 1 includes, among other components, a casing 2 with a central longitudinal bore 2*a* and a piston 3 is movably disposed within the casing bore 2*a*. The casing bore 2*a* extends generally between the drill first and second ends 1*a*, 1*b* and the casing 2 has a drive chamber $C_D$, a valve operation chamber $C_V$, and a supply chamber $C_S$ each defined within the bore 2*a*. The piston 3 has a central bore 3*a* and opposing strike and drive ends 3*b*, 3*c*, the drive end 3*c* being disposeable within the casing drive chamber $C_D$, and is linearly displaceable in opposing directions $d_1$, $d_2$ generally along the drill axis $A_D$. The channeling device 10 basically comprises an elongated body 12 disposeable at least partially within the casing bore 2*a* and having a material transport passage 14 extending completely through the body 12 and a fluid passage 16 configured to fluidly couple the valve and drive chambers $C_V$, $C_D$, respectively.

More specifically, the elongated body 12 has a central axis $A_B$ and is disposeable centrally within the casing bore 2*a* so as to extend generally along (and preferably collinearly with) the drill axis $A_D$ and through the piston bore 3*a*, with the drill and body axes $A_D$, $A_B$ being generally collinear. The elongated body 12 has a first end 12*a* locatable generally proximal to the drill first end 1*a*, a second end 12*b* spaced axially from the first end 12*a* and locatable generally proximal to the drill second end 1*b*. Further, the material transport passage 14 extends generally axially between the body first and second ends 12*a*, 12*b* and provides a path for moving solid materials (e.g., rock bits, soil, etc.) through the drill 1. As such, a material collection device 4 may be coupled with the channeling device 10 so that solid material displacing through the transport passage 14 passes out of the body second end 12*b* and into the collection device 4, as described in further detail below.

Preferably, the drill 1 further includes a fluid distributing member or "cylinder" 5 and a valve 6 each disposed within the casing 2. The cylinder 5 has at least one supply passage 5*a* fluidly coupling the supply chamber $C_S$ and the drive chamber $C_D$ and the valve 6 is movably disposed within the casing 2 so as to at least partially bound the valve chamber $C_V$ and is contactable with the cylinder 5. Specifically, the valve 6 is configured to control flow through the supply passage 5*a* and is displaceable between closed and open positions $V_C$, $V_O$, as described below. Further, the piston 3 is linearly displaceable along a portion of the elongated body 12 between a drive position $P_D$ (FIG. 6), at which the drive end 3*c* is located most proximal to the valve 6, and a strike position $P_S$ (FIGS. 3 and 4) at which the drive end 3*c* is located most distal with respect to the valve 6 and at which the strike end 3*b* drivingly contacts a bit 7, as described below.

Referring to FIGS. 5-10, with such a preferred drill structure, the body fluid passage 16 is configured to direct fluid from the drive chamber $C_D$ to the valve chamber $C_V$, such that the valve 6 is displaced toward the closed position $V_C$, thereby "cutting off" or preventing operating fluid flow into drive chamber $C_D$. Alternatively, the passage 16 is configured to direct fluid from the valve chamber $C_V$ to the piston bore 3*a* so as to evacuate the chamber $C_V$ when the valve 6 moves toward the open position $V_O$, at which position operating fluid flows from the supply chamber $C_S$ into the drive chamber $C_D$. More specifically, the channeling body 12 has an outer circumferential surface 18 and the body fluid passage 16 includes at least one valve port 20 and at least one drive port 22 spaced axially from the valve port 20, each port 20, 22 extending inwardly from the body outer surface 18. A main portion 24 of the fluid passage 16 extends generally axially between the at least one valve chamber port 20 and the at least one drive chamber port 22, as described in further detail below. The valve port 20 is configured to fluidly couple the fluid passage 16 with the valve chamber $C_V$ and the drive port 22 is configured to fluidly connect the fluid passage 16 with the drive chamber $C_D$.

Specifically, when the piston upper end 3*c* is spaced from the port 18 in the first direction $d_1$ and generally toward the strike position $P_S$, the drive chamber $C_D$ and the fluid passage 16 are fluidly coupled through the port 22. Alternatively, the fluid passage 16 is uncoupled from the drive chamber $C_D$ when the piston drive end 3*c* is spaced from the drive port 22 in the second direction $d_2$ and generally toward the drive position $P_S$, such that the drive port 22 is generally disposed within the piston bore 3*a*, and thus uncoupled or "disconnected" from the drive chamber $C_D$. Preferably, the channeling body 12 further has a pair of facing inner and outer circumferential surfaces 26, 28 spaced radially inwardly from the body outer surface 18 and defining a generally annular space $S_A$ extending coaxially about a portion of the transport passage 14. The annular space $S_A$ provides the fluid passage main portion 24, with each one of the valve and drive ports 20, 22 extending generally radially through the body 12 between the outer surface 18 and the inner circumferential surface 26, as discussed in greater detail below.

Figure 10:
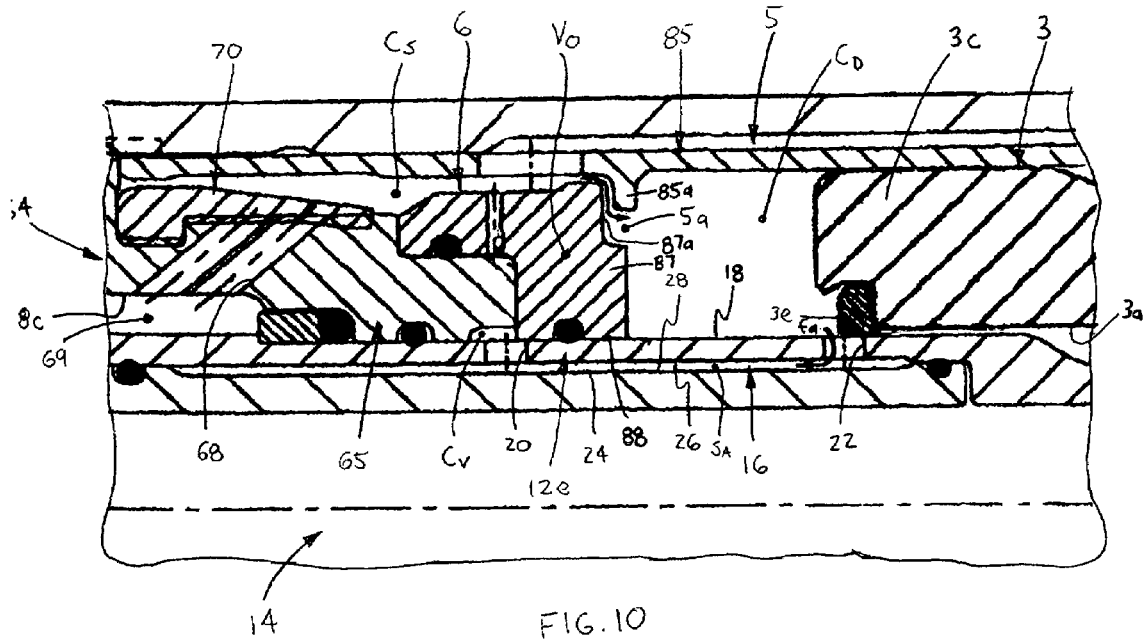
FIG. 10 is an enlarged view of a portion of FIG. 9, showing the valve just prior to movement toward the closed position.

With the above port and passage structure, the body fluid passage 16 is configured to direct a flow $f_a$ (FIG. 10) of pressurized operating fluid from the drive chamber $C_D$ into the valve chamber $C_V$. Thereby, the valve 6 is displaced toward the closed position $V_C$ when the piston drive end 3*c* moves generally across the drive port 22 during downward displacement of the piston 3 toward the strike position $P_S$, as shown in FIGS. 7 and 10. As such, the flow of operating fluid from the supply chamber $C_S$ to the drive chamber $C_D$ is interrupted or cut-off as, or preferably prior to, the piston 3 contacting the bit 7, which enables or at least facilitates the subsequent displacement of the piston 3 back to the drive position $P_D$. Further, when the piston 3 moves generally across the drive port 22 while displacing generally upwardly and back toward the drive position $P_D$ (see FIG. 6), the drive port 22 is then coupled with an upper exhaust passage 26, as described below. As such, any fluid within the valve chamber $V_C$ is forced into the exhaust passage 26 when the valve 6 is forced open by fluid compressed in the drive chamber $C_D$ by the piston drive end 3*c*, as discussed in greater detail below.

Figure 11:
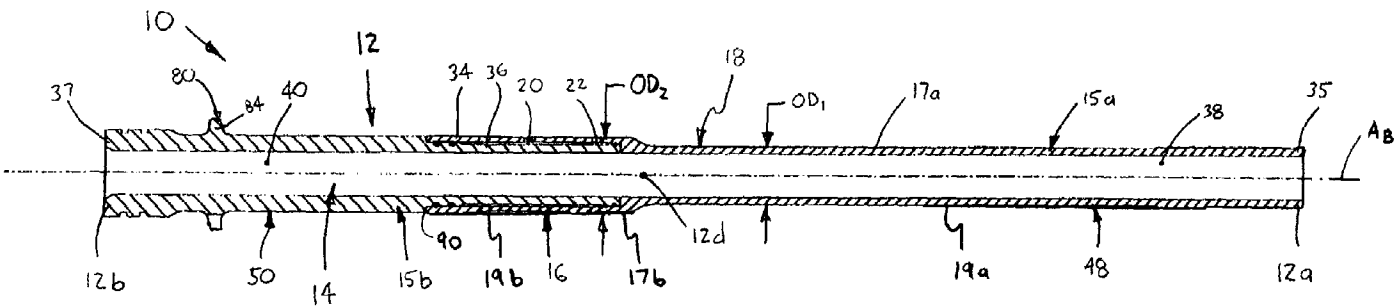
FIG. 11 is an axial cross-sectional view of the channeling device.

Referring to FIGS. 2, 3, 6 and 11, the elongated body 12 is preferably formed having a radially smaller clearance section 17*a*, which partially bounds a section of the drill exhaust passage 26, and a radially larger chamber sealing section 17*b*, about which the piston drive end 3*c* seals the drive chamber $C_D$. More specifically, the body 12 has a first outer circumferential surface section 19*a* extending axially between the body first end 12*b* and an intermediate point 12*d* on the body 12 and a second outer circumferential surface section 19*b* extending axially from the tube intermediate point 12*d* and at least partially toward the body second end 12*c*. As indicated in FIG. 11, the first outer surface 19*a* has a first outside diameter $OD_1$ and the second outer surface 19*b* has a second outside diameter $OD_2$, which is larger than the first diameter $OD_1$. As such, a body portion 15*a* extending from the intermediate point 12*d* to the body first end 12*b* is radially smaller than a body portion 15*b* extending from the intermediate point 12*d* toward the body second end 12*b*.

Figure 3:
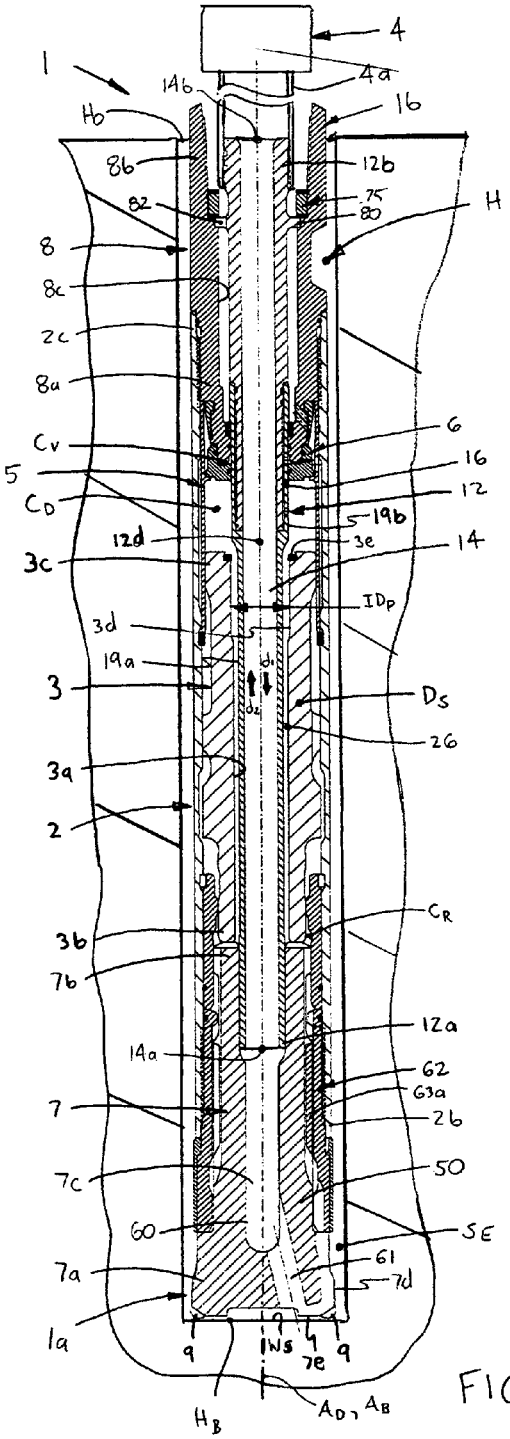
FIG. 3 is an axial cross-section view of the drill of FIG. 1, shown disposed within a working hole.
Figure 6:
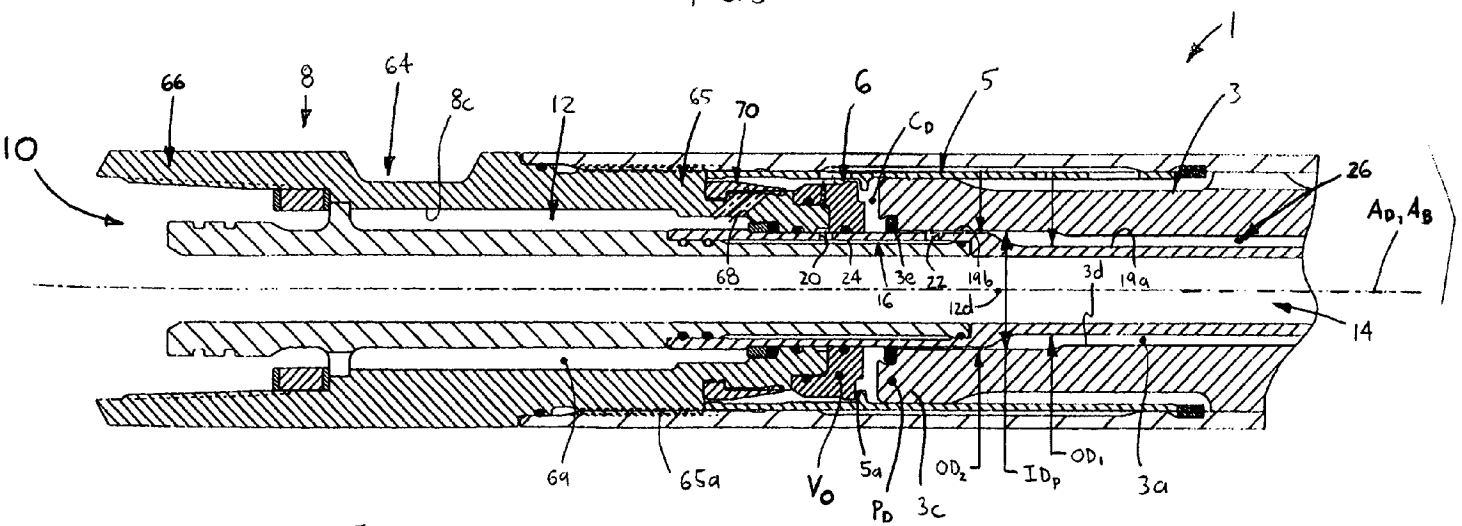
FIG. 6 is another view of the upper drill portion of FIG. 5, showing the drill in an upwardmost, drive position and the valve moved to an open position.
Figure 7:
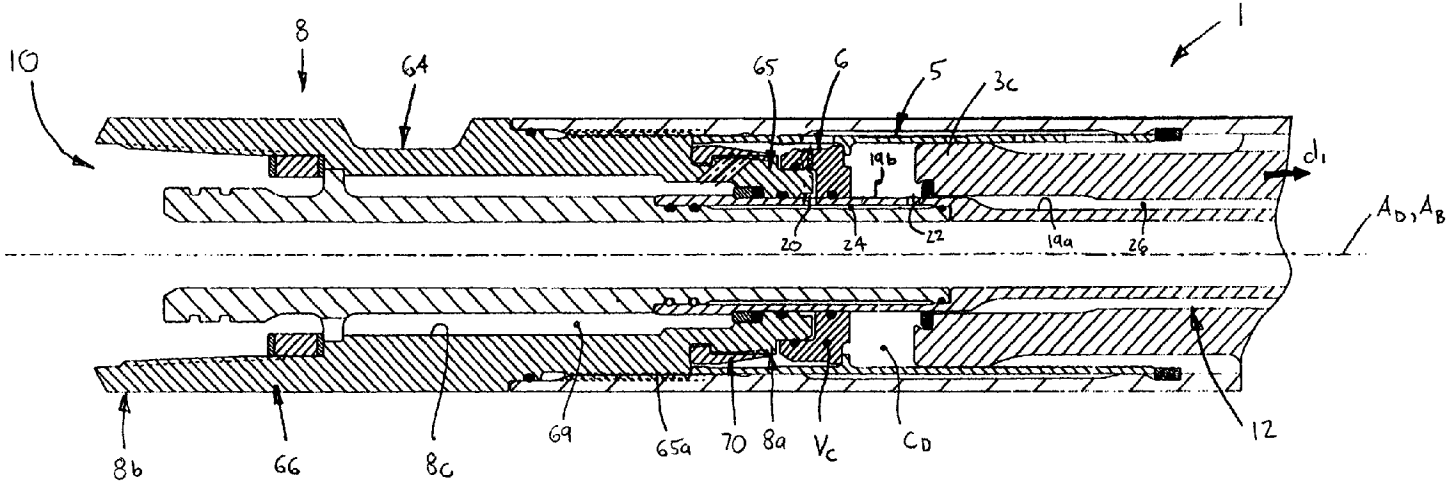
FIG. 7 is another view of the upper drill portion of FIG. 5, showing the drill moving in a first, downward direction toward a strike position and with the valve in a closed position
Figure 8:
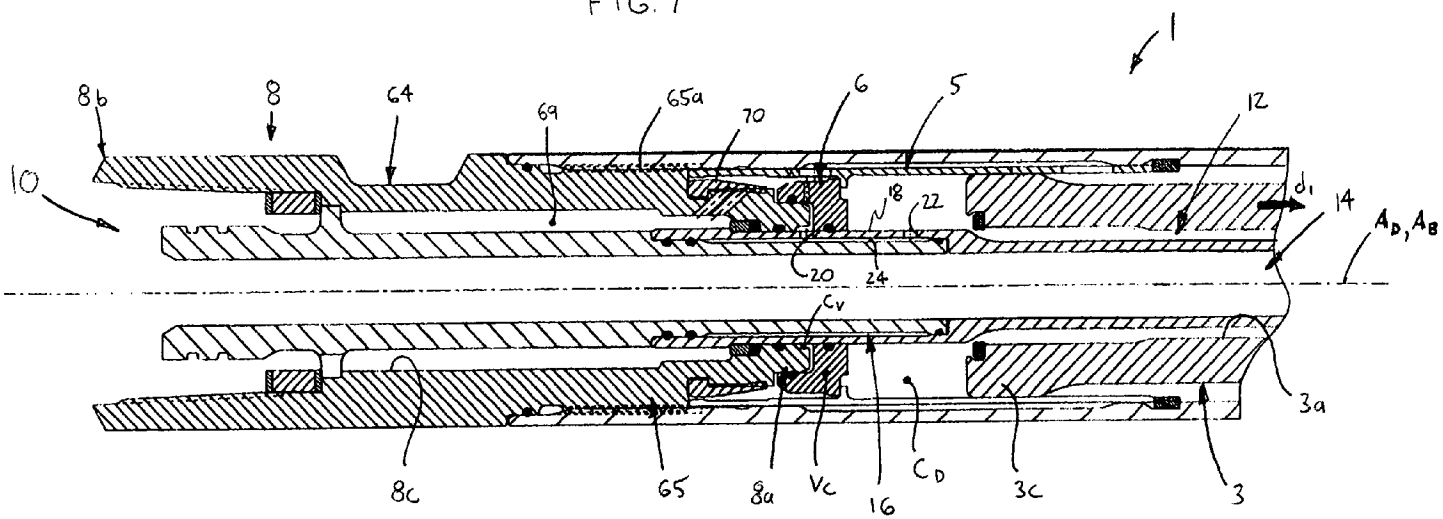
FIG. 8 is another view of the upper drill portion of FIG. 5, showing the drill moving downwardly past a channeling device drive chamber port and with the valve moved back to the closed position.

As best shown in FIGS. 3 and 6, the piston 3 further has an inner circumferential surface 3*d* defining the bore 3*a*, the inner surface 3*d* having an inside diameter $ID_P$. The piston surface inside diameter $ID_P$ is greater than the body first surface outside diameter $OD_1$, such that an annular, upper exhaust passage section 26 is defined between the body first outer surface 19*a* and the piston inside surface 3*d*. The exhaust passage section 26 at least partially fluidly connects the drive chamber $C_D$ with an exterior space $S_E$ outside of the drill 1 (i.e., part of working hole H), as discussed in further detail below. Furthermore, the second outer surface outside diameter $OD_2$ is generally equal to the piston inside diameter $ID_P$, and most preferably slightly lesser than the inside diameter of a piston seal member 3*e*, such that the piston 3 is generally slidable about the second outer surface 19*b*. As such, the drive chamber $C_D$ is fluidly connected with the exhaust passage 26 when the piston drive end 3*c* is disposed about the first outer surface section 19*a* and spaced axially downwardly from the second outer surface 19*b*. Alternatively, the drive chamber $C_D$ is substantially sealed from the exhaust passage 26 when the piston drive end 3*c* is disposed about the body second outer surface 19*b*, as shown in FIGS. 6, 7 and 10.

Referring now to FIGS. 1-4, as discussed above, the drill 1 preferably includes a bit 7 movably coupled with one end 2*b* of the casing 2 and further includes a backhead 8 connected with the opposing casing end 2*c*. The bit 7 has a first, outer end 7*a* disposed externally of the casing 2 so as to be spaced from the casing first end 2*b*, an opposing second or inner end 7*b* disposed within the casing bore 2*a* and drivingly contactable by the piston 3, as discussed below. A bit bore 7*c* extends generally between the bit outer and inner ends 7*a*, 7*b*. Further, the backhead 8 has a first, inner end connected with the casing second end 2*c*, an opposing second or outer end 8*b* connectable with a source of operating fluid (not shown), and a bore 8*c* extending between the backhead first and second ends 8*a*, 8*b*, the bit 7 and backhead 8 being described in greater detail below. When used with a drill 1 having these preferred components, the elongated body 12 is preferably sized such that the body first end 12*a* is disposed within the bit bore 7*c* and the body second end 12*b* is disposed within the backhead bore 8*c*. Specifically, the body first end 12*a* is most preferably spaced axially inwardly from the casing first end 2*b* and the body second end 12*b* is located generally proximal to the backhead second, outer end 8*b*, such that a portion of the body 12 extending through the casing second end 12*c*. As such, the material transport passage 14 has a first opening 14*a* (FIG. 3) coupled with the bit bore 7*c* and a second opening 14*b* (FIG. 3) coupled with material collection device 4, either directly or through appropriate piping or tubing 4*a* (as shown). Thus, any solid materials entering through the lower end of the bit bore 7*c* (i.e., broken up soil and/or rocks sheared off by the drill bit(s)) enters the channeling device 10 and passes completely through the drill 1.

Figure 2:
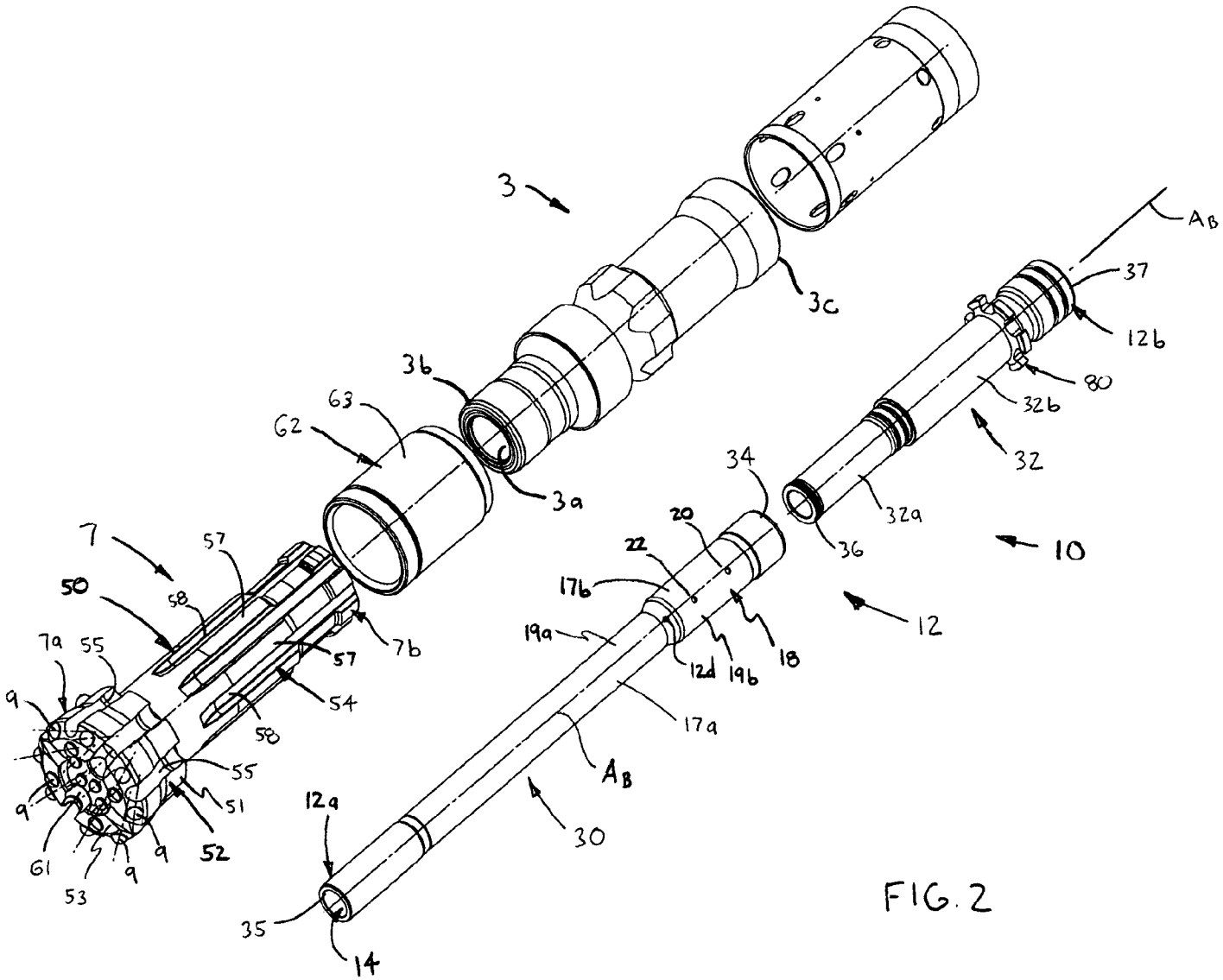
FIG. 2 is an exploded perspective view of the primary components of the drill of FIG. 1.
Figure 12:
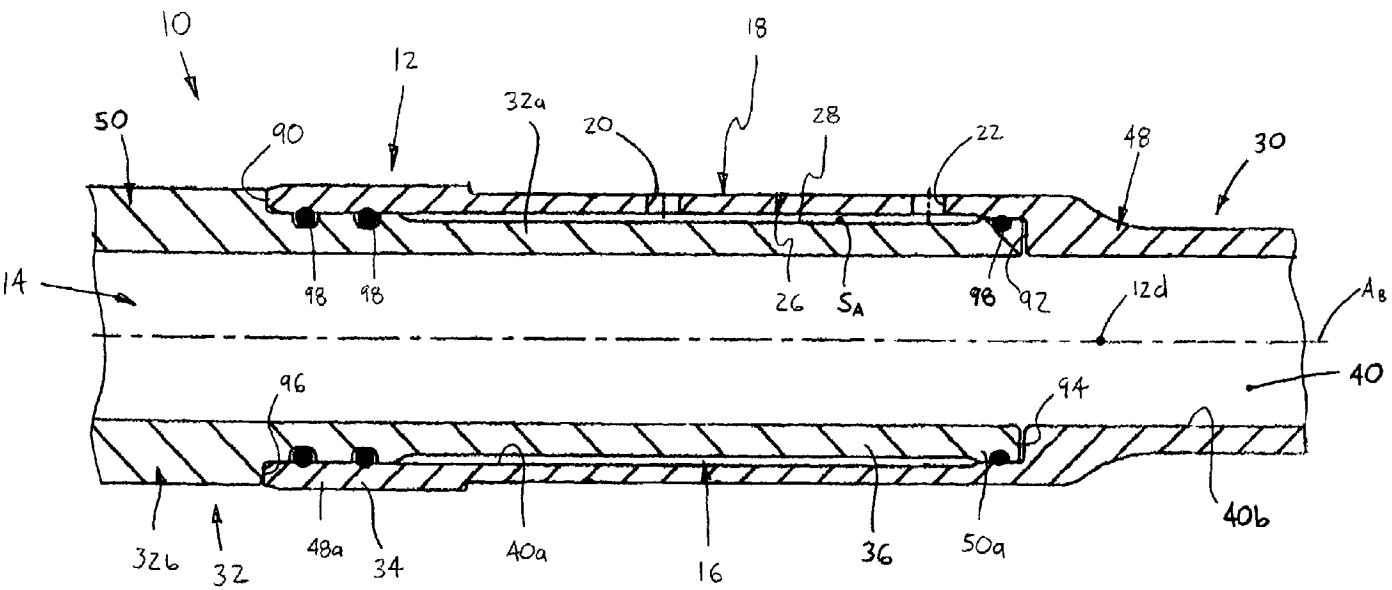
FIG. 12 is a greatly enlarged, broken-away axial cross-sectional view of interface section of two preferred body portions of the channeling device.

Referring to FIGS. 2, 11 and 12, the channeling device 10 is preferably generally formed of two-piece construction; specifically, the elongated body 12 includes first and second body portions 30, 32 each having inner and outer open ends 34, 35 and 36, 37, respectively, and a bore 38, 40, respectively, extending between the two open ends 34/35, 36/37. The inner end 36 of the second body portion 32 is formed or configured so as to be at least partially disposeable within the inner end 34 of the first body portion 30 to form the elongated body 12. Further, the bores 38, 40 of the two body portions 30, 32 are coupled or fluidly connected so as to thereby form the transport passage 14, such that the passage 14 extends between the first portion outer end 35 and the second portion outer end 37.

Further, the two body portions 30, 32 are preferably constructed as follows. The second body portion 32 is preferably formed with an inwardly stepped section 32*a* spaced radially inwardly from a remainder of the body portion 32*b* that extends axially inwardly from the body portion inner end 34. As such, the inner end 34 has an outer circumferential surface with an outside diameter $d_{b1}$, which provides the body outer surface 28 that partly bounds the fluid passage 16, as described above. The first body portion 30 is preferably formed with the bore 40 having an outwardly stepped section 40*a* spaced radially outwardly from a remainder of the bore 40*b* and that extends axially inwardly from the body portion inner end 34. Thus, the outwardly stepped bore section 40*a* has an inner circumferential surface with an inside diameter $d_{b2}$, which provides the body inner surface 26 partly defining the fluid passage 16. The inner surface inside diameter $d_{b2}$ is sufficiently greater than the outer surface outside diameter $d_{b1}$ such that the generally annular space $S_A$ is defined between the two body portion circumferential surfaces. In other words, the second body portion outwardly stepped bore section 40*a* is sized to receive at least a portion of the first body portion inwardly stepped section 32*a*, so as to thereby couple the two body portions 30, 32 and generally define the fluid passage 16. Most preferably, the body first and second portions 30, 32 are provided by first and second generally circular cylindrical tubes 48, 50, respectively, as described in detail below.

Referring to FIGS. 3-8, a reverse circulation drill 1 having a channeling device 10 operates generally as follows. As with all down-hole drills, the drill 1 basically functions to form a hole H having a bottom end $H_B$ and an open end $H_O$ (see FIG. 3), and when the drill 1 is disposed within the hole H, the material transport passage 14 is coupled (i.e., fluidly) with a portion of the hole H proximal to the bottom end $H_B$ and with either the hole open end $H_O$ or (preferably) with a material collection device 4. Further, the casing first end 2*b* and the bit lower end 7*a* are both located generally proximal to the hole bottom end $H_B$, while the casing second end 2*c* and the backhead 8 are spaced from the casing first end 2*b* in a direction generally toward the hole open end $H_O$. Further, the drill 1 is operated by directing working fluid (e.g., pressurized air, etc.) into the drive chamber $C_D$, such that the fluid "pushes" on the piston upper, drive end 3*c* to accelerate the piston 3 into contact with bit 7. As discussed above, each time the piston 3 accelerates in a first, typically downward direction toward the bit 7, the piston drive end 3*c* passes the drive port 22 so that operating fluid flows through the channeling device fluid passage 16 to move the valve 6 to the closed position $V_C$, cutting off the flow into the drive chamber $C_D$. When the piston 3 strikes the bit 7, the bit bottom, outer end 7*a* is driven into a work surface WS (e.g., a hole bottom) such that one or more drill bits 9 (discussed below) cut into the adjacent hole work surface WS and breaks loose materials therefrom.

Figure 4:
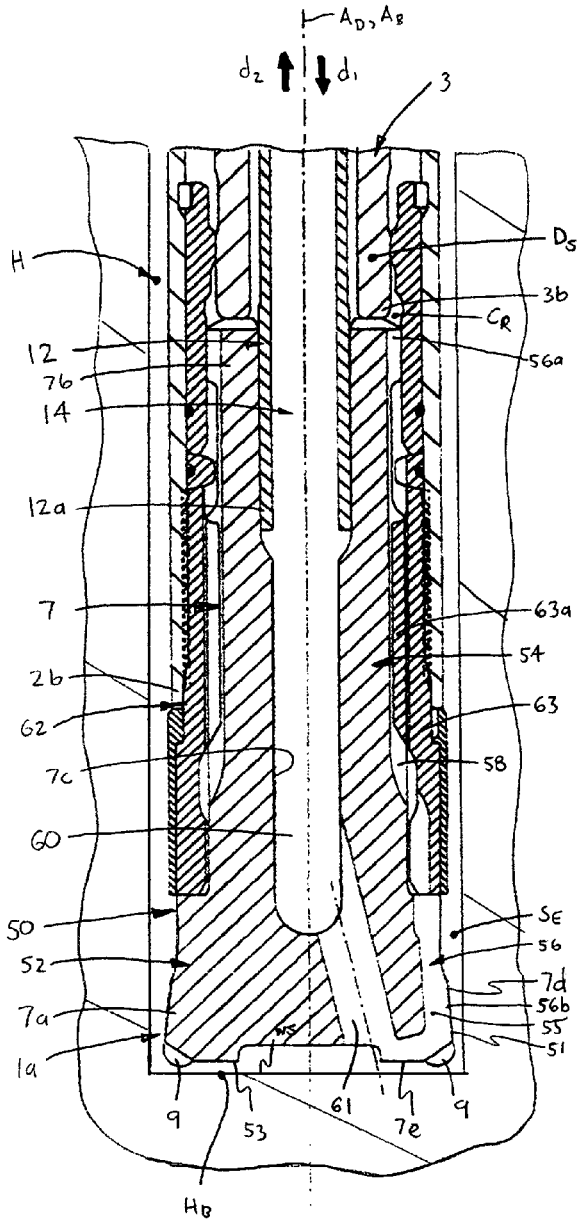
FIG. 4 is a greatly enlarged, broken-away portion of the cross-sectional view of FIG. 3, showing a lower portion of the drill and the channeling device.

Furthermore, with a reverse circulation drill, operating fluid is directed about the outer circumferential surface 7*d* of the drill bit 7 and generally toward the drill lower end 1*a*, such that the flow subsequently flows radially inwardly across the lower surface 7*e* toward the bit bore 7*c*, as best shown in FIGS. 3 and 4. Such fluid flow entrains solid materials, such as rock bits and dirt, and then flows into the bit bore 7*c* to the channeling body first end 12*a*, thereafter flowing through the material transport passage 14 and out of the channeling body second end 12*b*, preferably to a material collection device 4. Thus, the channeling device 10 of the present invention has the benefit of providing both a transport passage 14 for moving solid materials through the drill 1 and a valve activation fluid passage 16 for closing the valve 6, and preferably also seals the drive chamber $C_D$ from the upper exhaust passage 26 when the piston 3 travels in a "return stroke" back to the drive position $P_D$. Having described the basic components and operation above, these and other elements of the present invention are described in further detail below.

Referring to FIGS. 1-4, the channeling device 10 is preferably used with a reverse circulation drill 1 constructed as described above and as follows. The bit 7 preferably includes a generally cylindrical body 50 having a radially larger, outer or lower end 52 and a radially smaller, elongated inner or upper section 54. The body lower section 52 provides the bit outer end 7*a* and has generally radially extending bit mounting surface 53 configured to support a plurality of drill bits 9, and a plurality of axially extending grooves 55 each partially defining outer exhaust passage section 56, as described below (see FIG. 4). The body upper section 54 has a plurality of axially extending splines 57 for coupling the bit with the casing 2 and a plurality of extending grooves 58 between the splines 57 which each partially define a separate one of the lower exhaust passages 56. The exhaust passages 56 are each fluidly coupleable with a casing return chamber $C_R$ and the upper exhaust passage section 26 at a first end 56*a* and are coupled with exterior space $S_E$ about the bit lower section 52 at a lower end 56*b*, so as to direct fluid outwardly from the drill 1 as described above and in further detail below. Further, the bit bore 7*c* is preferably formed of a central, main portion 60 extending inwardly from the bit upper end 7*b* and at least two lower, angled portions 61. The bore angled portions 61 extend from the main portion 60 both axially toward the bit lower end 7*a* and partly radially outwardly towards a body outer circumferential surface 51. Furthermore, the drill 1 also preferably includes a bit retainer or "chuck" 62 attached to the casing first, lower end 2*b* and configured to retain the bit 7 slidably connected with the casing 2. Preferably, the chuck 62 includes a generally circular cylindrical tube 63 having a plurality of axially extending splines 63*a* engageable with the bit splines 57 to slidably retain the bit 7 within the casing bore 2*a* (see FIG. 4).

Figure 5:
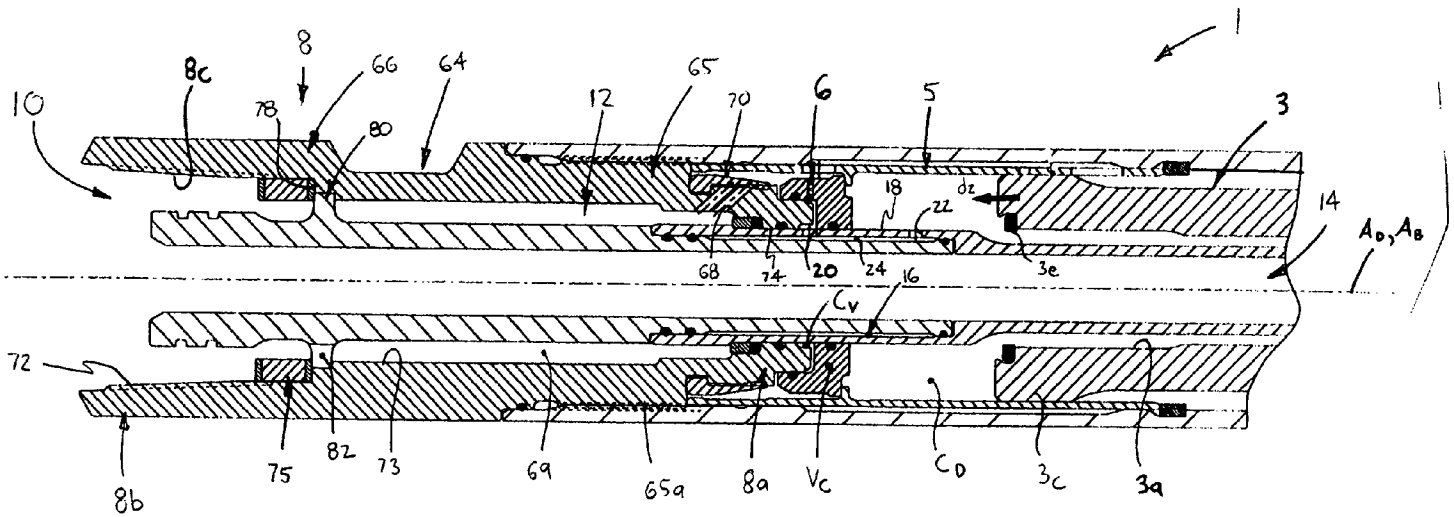
FIG. 5 is an enlarged, broken-away axial cross-sectional view of the upper portion of the drill, showing a piston moving in a second, upward direction toward a drive position and with a valve in a closed position.

Referring to FIGS. 1, 3 and 5-10, the backhead 8 preferably includes a generally circular cylindrical body 64 having a lower portion 65 disposeable within the casing second, upper end 2*c* and an upper portion 66 connectable with a source of operating fluid (not shown). The backhead body lower portion 65 has a threaded outer surface section 65*a* threadably engageable with the casing upper end 2*c* so as to removably connect the backhead 8 to the casing 2. The backhead body 64 includes at least one and preferably a plurality of supply ports 68, which each fluidly connect the backhead bore 8*c* with the fluid supply chamber $C_S$. When the channeling device body second end 12*b* is disposed within the backhead bore 8*c*, a generally annular backhead supply passage 69 is defined between the backhead bore 8*c* and a portion of the elongated body 12 disposed within the backhead bore 8*c*. The supply passage 69 is fluidly coupled with the casing supply chamber $C_S$ through the supply ports 68, so as to supply operating fluid to the chamber $C_S$, and the backhead 8*c* further includes an annular flap valve 70 for controlling flow out of the ports 68. Further, the backhead bore 8*c* is preferably defined by three axially spaced inner circumferential surfaces 72, 73, 74, as indicated in FIG. 5. An upper, radially largest inner surface section 72 is sized to receive a retainer ring 75 for retaining a centralizer portion 80 of the channeling device body 12, as described below. The lower, radially smallest inner surface section 74 is sized to fit closely about a portion of the elongated body 12, and has annular grooves for receiving sealing members 76 (e.g., O rings, etc.) to seal the backhead bore 8*c* from the casing drive chamber $C_D$.

Figure 9:
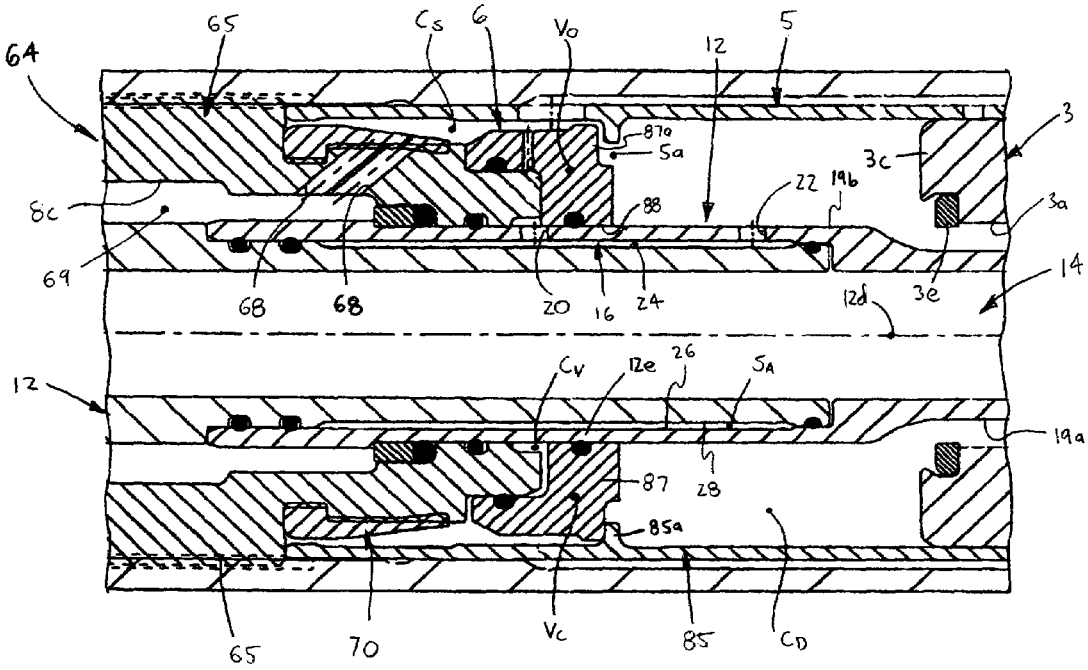
FIG. 9 is a greatly enlarged, broken away axial cross-sectional view of the drill, the upper half showing the valve in an open position and the lower half showing the valve in a closed position.

Referring now to FIGS. 9 and 10, the cylinder 5 preferably includes a generally tubular body 85 having a radially inwardly extending shoulder 85*a* and a central opening 86. The valve 6 preferably includes a generally cylindrical body 87 with a central bore 88 and radial surface 87*a*, the valve surface 87*a* being contactable with the distributor shoulder 85*a* at the valve closed position $V_C$. Further, a portion 12*e* of the channeling device elongated body 12 extends through the valve bore 88, such that the valve body 87 is slidable between the open and closed positions $V_O$, $V_C$ along the body portion 12*e*.

As shown in FIGS. 1-3, 5, 8 and 11, the channeling device body 12 preferably further includes a centralizer 80, which is spaced axially inwardly from the body second end 12*c*, and most preferably from the outer end of the second tube 50. The centralizer 80 extends radially outwardly from the tube outer surface 18 and circumferentially about the body axis $A_B$ and is configured to engage with the backhead bore 8*c* so to generally center the body 12 within the bore 8*c*. More specifically, the centralizer 80 is preferably disposeable against a radial shoulder 78 defined between the bore upper and central inner surfaces 72, 73, and the retainer ring 75 is contactable with the centralizer 80 such that the centralizer 80 is sandwiched between the shoulder 78 and the ring 75. Further, the centralizer 80 has at least one and preferably a plurality of flow openings 82 configured to permit operating fluid to flow through the centralizer 80 and between the backhead bore 8*c* and the body outer surface 18. Most preferably, the centralizer 80 is formed of a plurality of radially extending lugs 84 spaced circumferentially about the body axis $A_B$, such that the flow openings 82 are defined between each pair of adjacent lugs 84.

Figure 13:
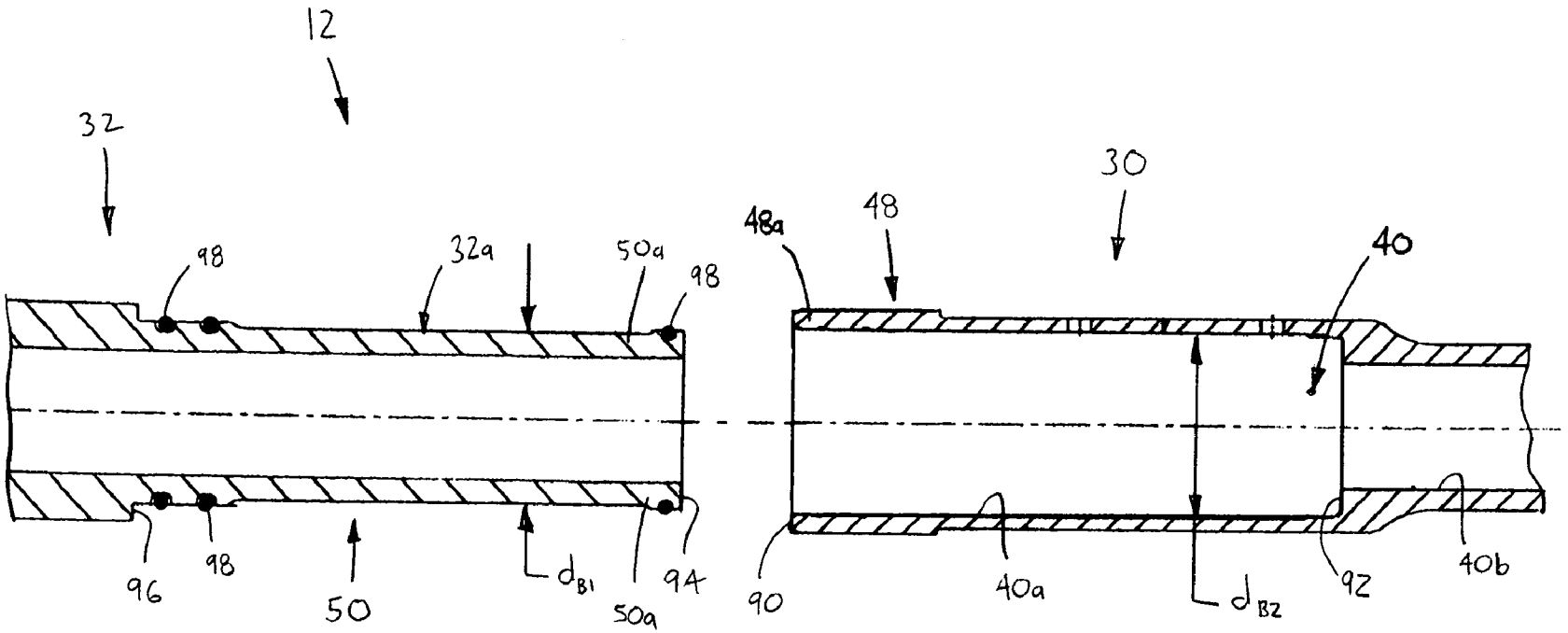
FIG. 13 is another view of the body portion interface of FIG. 12, showing the two body portions disengaged.

As best shown in FIGS. 11-13, the inner ends 48*a*, 50*a* of the preferred first and second tubes 48, 50 are preferably formed, and as such engage with each other, in the following manner. The first tube inner end 48*a* has a radial end surface 90 and the first tube bore 40 further has a shoulder surface 92 extending radially between the inwardly stepped bore section 40*a* and the remainder of the bore 40*b* and faces generally toward the tube inner end 48*a*. The second tube inner end 50*a* has a radial end surface 94 and the second tube 50 further has a shoulder surface 96 extending radially between the inwardly stepped section 32*a* and the body remainder portion 32*b*. Further, the two inwardly stepped sections 32*a*, 40*a* each have about the same axial length, such that when the second tube inner end 50*a* is disposed within the first tube inner end 48*a*, the second tube radial end surface 90 is disposed generally against the first tube shoulder surface 92 and the first tube end surface 90 is disposed against the second tube shoulder surface 96.

Furthermore, the channeling device 10 also preferably comprises at least two axially spaced apart, generally annular sealing members 98 disposed between the second tube inwardly stepped section 32*a* and the first tube outwardly stepped bore section 40*a*. At least one of the sealing members 98 is disposed proximal to the second tube inner end 50*a* and is configured to generally prevent fluid flow from the annular space $S_A$ through the second tube inner end 38*a*. Also, at least one and preferably two of the sealing members 98 is configured to generally prevent fluid flow from the annular space SA through the first tube inner end 48*a*. As such, the fluid passage 16 is substantially fluidly isolated from the material transport passage 14 and the backhead supply passage 69. Thus, the leakage of fluid through the tube ends 48*a*, 50*a* is minimized to ensure that the volume of fluid flowing through the passage 16 and into the valve chamber $C_V$ is sufficient to displace the valve 6 to the closed position $V_C$ (i.e., when the passage 16 is coupled with the drive chamber $C_D$ during piston displacement).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined in the appended claims.

I claim:

1. A device for channeling solids and fluids within a reverse circulating, fluid operated drill, the drill having first and second ends and an axis extending between the ends and including a casing, the casing having a central longitudinal bore extending generally between the drill first and second ends and a drive chamber, a fluid supply chamber, and a valve operation chamber each defined within the bore, a fluid distributor disposed within the casing and having at least one supply passage fluidly coupling the supply chamber and the drive chamber, a valve movably disposed within the casing so as to at least partially bound the valve chamber and being contactable with the distributor, the valve being configured to control flow through the supply passage and being displaceable between closed and open positions, and a piston having a central bore and being movably disposed within the casing bore, the channeling device comprising:

an elongated body disposeable at least partially within the casing bore so as to extend generally along the casing axis and through the piston bore, the body having a central longitudinal axis, a first end locatable generally proximal to the drill first end, a second end spaced axially from the first end and locatable generally proximal to the drill second end, a material transport passage extending axially between the body first and second ends and providing a path for moving solid materials through the drill, and a fluid passage configured to fluidly couple the valve and drive chambers, the body fluid passage is configured to direct fluid from the drive chamber to the valve chamber such that the valve is displaced toward the closed position and to alternatively direct fluid from the valve chamber to one of the drive chamber and the piston bore to at least facilitate movement of the valve toward the open position.

2. The channeling device as recited in claim 1 wherein:

the piston has a drive end disposeable within the drive chamber and is linearly displaceable along a portion of the elongated body between a drive position, at which the drive end is located most proximal to the valve, and a strike position at which the drive end is located most distal with respect to the valve; and the channeling body has an outer circumferential surface and the body fluid passage includes a valve port and a drive port each extending inwardly from the outer surface, the valve port being configured to fluidly connect the fluid passage with the valve chamber, the drive port being configured to fluidly connect the fluid passage with the drive chamber when the piston upper end is spaced from the port in a direction toward the strike position, the fluid passage being uncoupled from the drive chamber when the piston drive end is spaced from the drive port in a direction toward the strike position such that the drive port is generally disposed within the piston bore.

3. The channeling device as recited in claim 2 wherein the body fluid passage is configured to direct fluid from the drive chamber into the valve chamber such that the valve is displaced toward the closed position when the piston drive end moves generally across the drive port as the piston displaces toward the strike position.

4. The channeling device as recited in claim 1 wherein the body fluid passage includes at least one valve port fluidly coupleable with the valve chamber, at least one drive port spaced axially from the valve port and being fluidly coupleable with the drive chamber, and a passage main portion extending generally axially between the at least one valve chamber port and the at least one drive chamber port.

5. The channeling device as recited in claim 4 wherein the elongated body further has an outer surface extending circumferentially about the body axis and a pair of facing inner and outer circumferential surfaces spaced radially inwardly from the outer surface and defining a generally annular space, the annular space providing the fluid passage main portion, each one of the valve and drive ports extending generally radially through the body between the outer surface and the inner circumferential surface.

6. The channeling device as recited in claim 1 wherein:

the drill includes a bit movably coupled with the casing and a backhead, the bit having an outer end disposed externally of the casing so as to be spaced from the casing first end, an opposing inner end disposed within the casing bore and contactable by the piston, and a bore extending generally between the bit outer and inner ends, the backhead having a first end connected with the casing second end, an opposing second end connectable with a source of operating fluid, and a bore extending between the backhead first and second ends; and the elongated body is sized such that that the body first end is disposeable within the bit bore so as to be spaced axially inwardly from the casing first end and the body second end is disposeable within the backhead bore so as to be located proximal to the backhead second end, a portion of the body extending through the casing second end.

7. The channeling device as recited in claim 1 wherein the elongated body includes first and second body portions each having inner and outer open ends and a bore extending between the two open ends, the inner end of the second body portion being at least partially disposeable within the inner end of the first body portion to form the elongated body, the bores of the two body portions being fluidly connected so as to form the transport passage such that the passage extends between the first portion outer end and the second portion outer end.

8. The channeling device as recited in claim 7 wherein the body first portion inner end has an outer circumferential surface with an outside diameter, the body second portion inner end has an inner circumferential surface with an inside diameter, the inner surface inside diameter being greater than the outer surface outside diameter such that a generally annular space is defined between the two circumferential surfaces, the annular space providing at least a portion of the fluid passage.

9. The channeling device as recited in claim 7 wherein:

the body first portion has an inwardly stepped section spaced radially inwardly from a remainder of body portion and extending axially inwardly from the body portion inner end; and the bore of the body second portion has an outwardly stepped section spaced radially outwardly from a remainder of the bore and extending axially inwardly from the body second portion inner end, the second portion outwardly stepped bore section being sized to receive at least a portion of the first portion inwardly stepped section so as to couple the two body portions, at least a portion of the fluid passage being defined between the body portion inwardly stepped section and the bore outwardly stepped section.

10. The channeling device as recited in claim 1 wherein the body includes first and second generally circular cylindrical tubes each having inner and outer open ends and a bore extending between the two ends, the inner end of the second tube being at least partially disposeable within the inner end of the first tube so as to form the elongated body, the bores of the two tubes being coupleable so as to form the transport passage such that the passage extends between the first tube outer end and the second tube outer end.

11. The channeling device as recited in claim 10 wherein the second tube has an outer circumferential surface with an outside diameter, the first tube has an inner circumferential surface with an inside diameter, the inner surface inside diameter being greater than the outer surface outside diameter such that a generally annular space is defined between the two circumferential surfaces, the annular space providing at least a portion of the fluid passage.

12. The channeling device as recited in claim 11 wherein the first tube has at least one first port and at least one second port spaced axially from the first port, the first port being configured to fluidly connect the annular space with the valve chamber and the second port being configured to fluidly connect the annular space with the drive chamber.

13. The channeling device as recited in claim 10 wherein:

the second tube has an inwardly stepped section spaced radially inwardly from a remainder of the second tube and extending axially inwardly from the second tube inner end; and the bore of the first tube has an outwardly stepped section spaced radially outwardly from a remainder of the bore and extending axially inwardly from the first tube inner end, the first tube outwardly stepped bore section being sized to receive at least a portion of the second tube inwardly stepped section so as to couple the two tubes, at least a portion of the fluid passage being defined between the second tube inwardly stepped section and the first tube bore outwardly stepped section.

14. The channeling device as recited in claim 13 further comprising at least two axially spaced apart, generally annular sealing members disposed between the second tube inwardly stepped section and the first tube outwardly stepped bore section, at least one of the sealing members being configured to generally prevent fluid flow from the annular space through the first tube inner end and at least one of the sealing members being configured to generally prevent fluid flow from the annular passage through the second tube inner end.

15. The channeling device as recited in claim 13 wherein the first tube inner end has a radial end surface and the second tube further has a shoulder surface extending radially between the inwardly stepped bore section and the remainder of the bore and facing generally toward the second tube inner end, the first tube radial end surface being disposeable generally against the second tube shoulder surface when the first and second tubes are coupled together.

16. The channeling device as recited in claim 10 wherein:

the second tube has an inner circumferential surface extending between the inner and outer ends and having an inside diameter with a generally constant value along the axis; and the first tube has an inner circumferential surface extending between the stepped section and the tube outer end and having an inside diameter with a generally constant value along the axis, the value of the second tube inside diameter being generally equal to the value of the first tube inside diameter such that the material transport passage has a cross-sectional area that is generally constant at all points along the drill axis.

17. The channeling device as recited in claim 10 wherein:

the piston has a drive end disposeable within the drive chamber and an inner circumferential surface, the inner surface at least partially defining the piston bore and having an inside diameter; and one of the first and second tubes has a first outer circumferential surface section extending axially between the tube outer end and an intermediate point on the tube, the first outer surface having a first outside diameter, and a second outer circumferential surface extending axially from the tube intermediate point at least partially toward the tube inner end and having a second outside diameter, the piston inside diameter being greater than the first outside diameter such that an annular exhaust passage is defined between the tube first outer surface and the piston inside surface, the exhaust passage at least partially fluidly connecting the drive chamber with an exterior space outside of the drill, the second outside diameter being generally equal to the piston inside diameter such that piston is generally slidable about the tube second outer surface, the drive chamber being fluidly connected with the exhaust passage when the piston drive end is disposed about the tube first outer surface and spaced axially from the tube second surface and the drive chamber is substantially sealed from the exhaust passage when the piston drive end is disposed about the tube second outer surface.

18. The channeling device as recited in claim 10 wherein the first and second tubes are disposed within the drill such that the first tube outer end is located generally proximal to the casing first end and provides the elongated body first end and the second tube outer end is located generally proximal to the casing second end and provides the elongated body second end.

19. The channeling device as recited in claim 1 wherein the drill further includes a material collection device and the body second end is connectable with the collection device such that solid material displacing through the transport passage passes out of the body second end and into the collection device.

20. The channeling device as recited in claim 1 wherein:

the drill functions to form a hole having a bottom end and an open end, the casing first end being located generally proximal to the hole bottom end and the casing second end being spaced from the casing first end in a direction generally toward the hole open end; and the material transport passage has a first opening connectable with a portion of the hole proximal to the hole bottom end and a second opening connectable with at least one of the hole open end and a material collection device.

21. A fluid operated drill comprising:

a casing having first and second ends, a longitudinal bore extending between the two ends, and an axis extending centrally through the bore, and a drive chamber, a fluid supply chamber and a valve activation chamber each defined within the bore;

the distributor being disposed within the casing bore generally between the supply and drive chambers and having at least one supply passage fluidly coupling the supply chamber and the drive chamber;

a valve configured to control flow through the supply passage. the valve at least partially bounding the valve chamber and being displaceable between closed and open positions;

a piston having a central bore and being movably disposed within the casing bore in opposing directions along the casing axis; and a channeling device including an elongated body disposeable at least partially within the casing bore so as to extend generally along the casing axis and through the piston bore, the body having a first end located generally proximal to the casing first end, a second end located generally proximal to the casing second end, a material transport passage extending between the body first and second ends and providing a path for moving solid materials through the drill, and a fluid passage configured to fluidly couple the valve and drive chambers, the elongated body fluid passage being configured to direct fluid from the drive chamber to the valve chamber such that the valve is displaced toward the closed position and to alternatively direct fluid from the valve chamber to one of the drive chamber and the piston bore to at least facilitate movement of the valve toward the open position.

22. The fluid operated drill as recited in claim 21 further comprising:

a bit movably coupled with the casing, the bit having a first end disposed externally of the casing, an upper end drivingly contactable by the piston, and a bore extending between the first and second ends;

at least one drill bit mounted to the bit first end and configured to cut material; and a material collection device configured to receive solid material from the channeling device;

wherein the channeling device lower end is disposed within the bit bore and the material transport passage has a first opening, the first opening being connectable with the bit bore so as to receive material cut by the at least one bit, and a second opening connectable with the material collection device.

23. The fluid operated drill as recited in claim 21 wherein:

the piston has a drive end disposeable within the drive chamber and is linearly displaceable along a portion of the elongated body between a drive position, at which the drive end is located most proximal to the valve, and a strike position at which the drive end is located most distal with respect to the valve; and the elongated body further has an outer circumferential surface and the body fluid passage includes a valve port and a drive port each extending inwardly from the outer surface, the valve port being configured to fluidly connect the fluid passage with the valve chamber, and the drive port being configured to fluidly connect the fluid passage with the drive chamber when the piston upper end is spaced from the port in a direction toward the strike position, the fluid passage being uncoupled from the drive chamber when the piston drive end is spaced from the drive port in a direction toward the strike position such that the drive port is generally disposed within the piston bore.

24. The fluid operated drill as recited in claim 23 wherein the channeling body fluid passage is configured to direct fluid from the drive chamber into the valve chamber such that the valve is displaced toward the closed position when the piston drive end moves generally across the drive port as the piston displaces toward the strike position.

25. The fluid operated drill as recited in claim 21 further comprising a backhead having a first end connected with the casing second end, an opposing second end connectable with a source of operating fluid, a bore extending between the backhead first and second ends, and at least one supply port fluidly connecting the backhead bore with the fluid supply chamber, the channeling device elongated body extending partially into the backhead bore such that the body second end is disposed generally proximal to the backhead second end, a generally annular backhead supply passage being defined between the backhead bore and a portion of the elongated body disposed within the backhead bore.

26. The fluid operated drill as recited in claim 21 wherein:

the distributor includes a generally tubular body having a radially inwardly extending shoulder and a central opening;

the valve includes a generally cylindrical body with a central bore and radial surface contactable with the shoulder; and a portion of the channeling device elongated body extends through the valve bore such that the valve body is slidable between the open and closed positions along the body portion.

27. The channeling device as recited in claim 21 wherein the channeling device elongated body fluid passage includes at least one valve port fluidly coupleable with the valve chamber, at least one drive port spaced axially from the valve port and fluidly coupleable with the drive chamber, and a main passage portion extending generally axially between the at least one valve chamber port and the at least one drive chamber port.

28. The fluid operated drill as recited in claim 21 further comprising a backhead having a first end connected with the casing second end, an opposing second end connectable with a source of operating fluid, and a longitudinal bore extending between the backhead first and second ends, the backhead bore being configured to receive a portion of the channeling device elongated body and the elongated body being sized such that the body second end is disposed generally proximal to the backhead second end and spaced axially outwardly from the casing second end.

29. The fluid operated drill as recited in claim 28 wherein the channeling device body further includes an outer circumferential surface and a centralizer spaced from the body second end, extending radially outwardly from the outer surface and circumferentially about the axis, the centralizer being configured to engage with the backhead bore so to generally center the body within the backhead bore, the centralizer having at least one flow opening configured to permit operating fluid to flow through the centralizer and between the backhead bore and the body outer surface.

30. The fluid operated drill as recited in claim 21 further comprising a bit movably connected with the casing and including a first end disposed externally of the casing and configured to support at least one drill bit, a second end disposed within the casing bore and drivingly contactable by the piston, and a bore extending generally between the first and second ends, the bore being configured to receive a portion of the channeling device body and the body being sized such that the body first end is disposed within the bit bore so as to be spaced axially inwardly from the casing first end.

31. The fluid operated drill as recited in claim 21 further comprising a bit connected with the casing lower end and having central bore and a backhead connected with the casing upper end and having a central bore, wherein the elongated body lower end is disposed within the bit bore and the elongated body second end is disposed within the backhead bore such that material entering the bit bore passes through transport passage and out of the backhead bore.

32. The fluid operated drill as recited in claim 21 wherein the elongated body includes first and second generally circular cylindrical tubes each having inner and outer open ends and a bore extending between the two ends, the inner end of the first tube being at least partially disposeable within the inner end of the second tube so as to form the elongated body, the bores of the two tubes being coupleable so as to form the transport passage such that the passage extends between the first tube outer end and the second tube outer end.

33. A device for channeling solids and fluids within a reverse circulating, fluid operated drill, the drill having first and second ends and an axis extending between the ends and including a casing, the casing having a central longitudinal bore extending generally between the drill first and second ends and a drive chamber and a valve operation chamber each defined within the bore, and a piston having a central bore and being movably disposed within the casing bore, the channeling device comprising:

a first generally circular tube disposeable at least partially within the casing bore so as to extend generally along the casing axis and through the piston bore, the body having a central longitudinal axis, an outer end locatable generally proximal to the drill first end, an inner end spaced axially from the outer end, and a central bore extending between the inner and outer ends; and a second generally circular tube disposeable at least partially within the casing bore so as to extend generally along the casing axis and spaced axially from the first tube, the second tube having an outer end locatable generally proximal to the drill second end, an inner end spaced axially from the outer end, and a bore extending between the first and second ends, the second tube inner end being connectable with the first tube inner end so as to at least partially form a fluid passage configured to fluidly couple the valve and drive chambers and to connect the bores of the first and second tubes to form a material transport passage, the transport passage providing a path for moving solid materials through the drill.

34. A device for channeling solids and fluids within a reverse circulating, fluid operated drill, the drill having first and second ends and an axis extending between the ends and including a casing, the casing having a central longitudinal bore extending generally between the drill first and second ends and a drive chamber and a valve operation chamber each defined within the bore, and a piston movably disposed within the casing bore, the channeling device comprising:

an elongated body disposeable at least partially within the casing bore so as to extend generally along the casing axis and through the piston bore, the body having a central longitudinal axis, a first end locatable generally proximal to the drill first end, a second end spaced axially from the first end and locatable generally proximal to the drill second end, a material transport passage extending axially between the body first and second ends and providing a path for moving solid materials through the drill, and a fluid passage configured to fluidly couple the valve and drive chambers, the body including first and second generally circular cylindrical tubes each having inner and outer open ends and a bore extending between the two ends, the inner end of the second tube being at least partially disposeable within the inner end of the first tube so as to form the elongated body, the bores of the two tubes being coupleable so as to form the transport passage such that the passage extends between the first tube outer end and the second tube outer end.

35. A fluid operated drill comprising:

a casing having first and second ends, a longitudinal bore extending between the two ends, and an axis extending centrally through the bore, and a drive chamber and a valve activation chamber each defined within the bore;

a piston movably disposed within the casing bore in opposing directions along the casing axis;

a channeling device including an elongated body disposeable at least partially within the casing bore so as to extend generally along the casing axis and through the piston bore, the body having a first end located generally proximal to the casing first end, a second end located one of generally proximal to the casing second end, a material transport passage extending between the body first and second ends and providing a path for moving solid materials through the drill, and a fluid passage configured to fluidly couple the valve and drive chambers; and a backhead having a first end connected with the casing second end, an opposing second end connectable with a source of operating fluid, and a longitudinal bore extending between the backhead first and second ends, the backhead bore being configured to receive a portion of the channeling device elongated body and the elongated body being sized such that the body second end is disposed generally proximal to the backhead second end and spaced axially outwardly from the casing second end;

wherein the channeling device body further includes an outer circumferential surface and a centralizer spaced from the body second end, extending radially outwardly from the outer surface and circumferentially about the axis, the centralizer being configured to engage with the backhead bore so to generally center the body within the backhead bore, the centralizer having at least one flow opening configured to permit operating fluid to flow through the centralizer and between the backhead bore and the body outer surface.

* * * * *